US009498818B2

(12) United States Patent
Koyama et al.

(10) Patent No.: US 9,498,818 B2
(45) Date of Patent: Nov. 22, 2016

(54) CASTING MOLD AND CAST ARTICLE PRODUCED USING THE SAME

(71) Applicants: Tomohiro Koyama, Toyota (JP); Motoaki Ozaki, Okazaki (JP); Yuichi Furukawa, Toyota (JP); Shuji Sotozaki, Okazaki (JP); Hiroaki Wakai, Omihachiman (JP)

(72) Inventors: Tomohiro Koyama, Toyota (JP); Motoaki Ozaki, Okazaki (JP); Yuichi Furukawa, Toyota (JP); Shuji Sotozaki, Okazaki (JP); Hiroaki Wakai, Omihachiman (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 14/409,203

(22) PCT Filed: Aug. 2, 2013

(86) PCT No.: PCT/IB2013/001697
§ 371 (c)(1),
(2) Date: Dec. 18, 2014

(87) PCT Pub. No.: WO2014/024021
PCT Pub. Date: Feb. 13, 2014

(65) Prior Publication Data

US 2015/0165517 A1 Jun. 18, 2015

(30) Foreign Application Priority Data

Aug. 10, 2012 (JP) ..... 2012-178870

(51) Int. Cl.

| | |
|---|---|
| ***B22D 17/22*** | (2006.01) |
| ***B22C 3/00*** | (2006.01) |
| ***B22C 9/06*** | (2006.01) |
| ***B22D 17/20*** | (2006.01) |
| ***B22D 21/04*** | (2006.01) |
| ***C22C 21/00*** | (2006.01) |

(52) U.S. Cl.
CPC . *B22C 3/00* (2013.01); *B22C 9/06* (2013.01); *B22D 17/2007* (2013.01); *B22D 17/22* (2013.01); *B22D 21/04* (2013.01); *C22C 21/00* (2013.01)

(58) Field of Classification Search
USPC ..... 65/374.15; 349/114.1, 115; 428/408
See application file for complete search history.

(56) References Cited

U.S. PATENT DOCUMENTS

| | | | | |
|---|---|---|---|---|
| 2006/0026996 | A1* | 2/2006 | Chen | B82Y 30/00 65/374.13 |
| 2011/0133053 | A1 | 6/2011 | Furukawa et al. | |
| 2011/0223339 | A1 | 9/2011 | Furukawa et al. | |

FOREIGN PATENT DOCUMENTS

| | | | |
|---|---|---|---|
| CN | 102239013 | A | 11/2011 |
| EP | 1 787 956 | A1 | 5/2007 |

(Continued)

OTHER PUBLICATIONS

International Search Report and Written Opinion for corresponding International Application No. PCT/IB2013/001697 mailed Apr. 16, 2014.

*Primary Examiner* — Archene Turner
(74) *Attorney, Agent, or Firm* — Sughrue Mion, PLLC

(57) ABSTRACT

A casting mold includes a carbon film with which at least a surface of the casting mold which forms a cavity is covered, and mold oil with which a surface of the carbon film is coated. In the casting mold, aluminum powder is added to the mold oil.

7 Claims, 4 Drawing Sheets

(56) References Cited

FOREIGN PATENT DOCUMENTS

| | | | |
|---|---|---|---|
| EP | 2 314 399 | A1 | 4/2011 |
| GB | 2 090 285 | A | 7/1982 |
| JP | 07214275 | A | 8/1995 |
| JP | 2003-326343 | A | 11/2003 |
| JP | 2007-144499 | A | 6/2007 |
| JP | 2010-036194 | A | 2/2010 |
| JP | 2010-082650 | A | 4/2010 |
| SU | 850256 | A1 | 7/1981 |

* cited by examiner

CASTING MOLD AND CAST ARTICLE PRODUCED USING THE SAME

BACKGROUND OF THE INVENTION

1. Field of the Invention

The invention relates to a casting mold in which at least a surface of the casting mold which forms a cavity is covered with a carbon film, and a cast article produced using the casting mold.

2. Description of Related Art

A technology of casting a metal product using a casting mold makes it possible to manufacture a large quantity of products having a certain shape and a certain level of quality, and this technology is applied to production of cast articles made of various metal materials. In a casting process, a surface of the casting mold, which forms a cavity to be filled with molten metal, is generally coated with a mold release agent. Thus, when the formed product is taken out of the casting mold, the cast product or article is easily released from the casting mold. However, if the casting process is repeated, the metal material may seize or adhere to the casting mold, or it may become difficult for the cast article to be released from the casting mold.

For example, when an aluminum alloy, or the like, is cast by a die casting method, molten aluminum is charged into the cavity of the casting mold at a high speed and a high pressure. As a result, seizing of molten metal may occur at a portion of the casting mold which contacts with the molten aluminum, or the mold release resistance may become large when the cast article is taken out of the casting mold, whereby a part of the cast article may adhere to the casting mold.

In view of the above point, a casting mold has been proposed in which at least a surface of the casting mold, which forms a cavity, is covered with a carbon film comprised of nanocarbon, and the carbon film is coated with fullerenes (see, for example, Japanese Patent Application Publication No. 2010-036194 (JP 2010-036194 A)).

However, even in the case where the casting mold as described in JP 2010-036194 A is used, the pulling resistance of the casting mold is high, and a part' of the cast article may adhere to the inside of the casting mold if the draft of the casting mold is small. In this case, it may be considered to increase the draft, but the increase of the draft may result in reduction of the degree of freedom for the shape of the cast article.

SUMMARY OF THE INVENTION

The invention provides a casting mold that makes it easier to release a cast article from the casting mold even when the draft, of the casting mold is small, and reduce the possibility that a part of the cast article adheres to the casting mold. The invention also provides a cast article produced using the casting mold.

A first aspect of the invention is concerned, with a casting mold. The casting mold includes a carbon film with which at least a surface of the casting mold which forms a cavity is covered, and a mold oil with which a surface of the carbon film is coated. An aluminum powder is added to the mold oil.

According to the above aspect of the invention, the aluminum powder is added to the mold oil, so that the aluminum powder on which an oil film of the mold oil is formed is present between the surface of the casting mold which forms the cavity, and the surface of the cast article, during casting. As a result, when the cast article is released from the casting mold, the aluminum powder reduces the pulling resistance of the casting mold against the cast article, and the ease with which the cast article is released from the cast mold can be increased.

In the above aspect of the invention, the aluminum powder may consist of flake aluminum particles.

With the powder consisting of flake aluminum particles thus added to the mold oil, the flake aluminum particles are present between the surface of the casting mold and the surface of the cast article while being opposed to these surfaces, when the cast article is removed from the casting mold. Thus, the pulling resistance between the surface of the casting mold which forms the cavity, and the surface of the cast article, can be further reduced, via the flake aluminum particles.

In the above aspect of the invention, a graphite powder may be further added to the mold oil.

With the graphite powder thus further added to the mold oil, particles of the graphite powder are present between the particles of the aluminum powder added to the mold, oil. As a result, adhesion between the particles of the aluminum powder is curbed, and friction between the cavity-forming surface of the casting mold and the surface of the cast article can be reduced.

In the above aspect of the invention, the graphite powder may consist of flake graphite particles.

With the powder consisting of the flake graphite particles thus added to the mold oil, the flake graphite particles are likely to be present between the aluminum particles. As a result, the pulling resistance between the cavity-forming surface of the casting mold and the surface of the cast article can be further reduced.

In the above aspect of the invention, the mold oil may contain 10 to 34 mass % of the aluminum powder, 24 mass % or less of the graphite powder, and 40 to 64 mass % of refined mineral oil having a heatproof temperature of 250° C. or higher.

By using the mold oil as described above, the cast article is more easily released from the casting mold, and a part of the cast particle is less likely or unlikely to adhere to the casting mold.

In the above aspect of the invention, the carbon film may contain at least one type of nanocarbons selected from the group consisting of carbon nanocoils, carbon nanotubes, and carbon nanofilaments.

By using the carbon film containing nanocarboris as described above, the mold oil finds its way into clearances or projections and recesses of nanocarbons, so that the mold oil can be retained in the carbon film. Consequently, the friction of the surface of the carbon film can be reduced.

A second aspect of the invention is concerned with a cast article. The cast article is produced by using the casting mold as described above.

According to the above aspect of the invention, a part of the cast article produced using the casting mold as described above is less likely or unlikely to adhere to the casting mold. Further, the draft of the casting mold can be reduced to be smaller than that of a conventional mold, so that a cast article having a desired shape can be obtained.

According to the first and second aspects of the invention, even when the draft of the casting mold is small, the cast article can be more easily released from the casting mold, and a part of the cast article is less likely or unlikely to adhere to the casting mold. This makes it possible to reduce the maintenance of the casting mold, and improve the production efficiency. Also, the draft of the casting mold can be reduced to be smaller than that of the conventional mold; therefore, a cast article having a desired shape can be obtained.

BRIEF DESCRIPTION OF THE DRAWINGS

Features, advantages, and technical and industrial significance of exemplary embodiments of the, invention will be described below with reference to the accompanying drawings, in which like numerals denote like elements, and wherein.

DETAILED DESCRIPTION OF EMBODIMENTS

One embodiment of the invention will be described with reference to FIG. 1A to FIG. 1C.

Figure 1A:
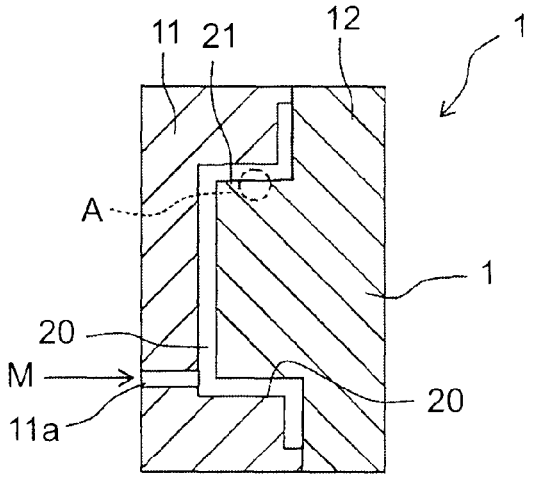
FIG. 1A is a schematic cross-sectional view of a casting mold according to one embodiment of the invention.

As shown in FIG. 1A, a casting mold 1 according to this embodiment is suitable for casting a cast article made of aluminum or aluminum alloy. A base material of the casting mold 1 is an iron-based material, such as hot work tool steel. The casting mold 1 consists of a pair of split casting molds. 11, 12. One of the split casting molds 11 and the other split casting mold 12 are clamped, so that a cavity 20 that conforms to the shape of the cast article is formed in the casting mold 1. The above-indicated one split, casting mold 11 is provided with a gate 11*a* through which molten metal is poured into the cavity 20. A molten metal, such as an aluminum alloy, is poured into the cavity 20 through the gate 11*a*.

Figure 1B:
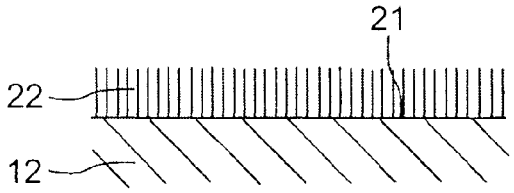
FIG. 1B is a partially enlarged view of part A in FIG. 1A, which is a schematic cross-sectional view showing a surface condition of the casting mold before it is coated with mold oil.

As shown in FIG. 1B, at least a surface 21 that forms the cavity 20, as a part of surfaces of the pair of split casting molds 11, 12, is covered with a carbon film 22. The carbon film 22 is a film including at least one type of nanocarbon selected from the group consisting of carbon nanocoils, carbon nanotubes, and carbon nanofilaments.

To form the carbon film 22 containing nanocarbon, a method of forming the carbon coating 22 containing nanocarbons, such as carbon nanocoils, carbon nanotubes, and carbon filaments, on the surface 21 of the split casting molds 11, 12 of the casting mold 1, as disclosed in Japanese Patent Application Publication No. 2008-105082 (JP 2008-105082 A), for example, may be employed.

More specifically, an atmosphere furnace is used, and the split casting molds (substrate) 11, 12 are housed in a heating chamber of the atmosphere furnace. The atmosphere in the furnace is replaced by non-oxidizing gas, such as nitrogen gas, hydrogen gas, or argon gas. Then, heating is started. The temperature in the furnace is elevated by heating to a given temperature. Thereafter, chain unsaturated hydrocarbon gas, such as acetylene gas ($C_2H_2$), is supplied as a carbon source gas. As a result, the hydrocarbon is decomposed into carbon and hydrogen, on the surface of the substrate, and carbon nanocoils, carbon nanotubes, and carbon filaments grow, due to catalysis of metals (Fe, Ni, Co) contained in the substrate. In this manner, the carbon film 22 in which a mixture of these nanocarbons exists can be formed on the surface 21 of the casting mold 1 (11, 12).

Figure 1C:
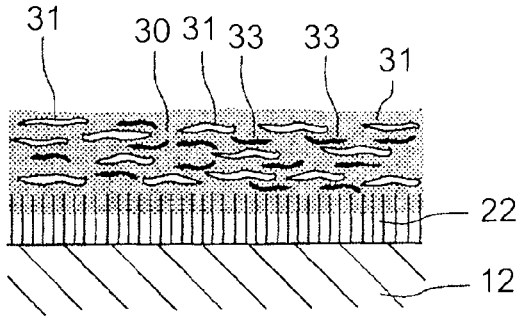
FIG. 1C is a schematic cross-sectional view showing a surface condition of the casting mold after the casting mold of FIG. 1B is coated with mold oil.

Furthermore, as shown in FIG. 1C, the surface of the carbon film 22 of the split mold (substrate) 12 is coated with mold oil (mold release agent) 30. Aluminum powder and graphite powder are added to the mold oil 30. More specifically, the mold oil 30 includes at least a refined mineral oil as a main material, and further includes at least aluminum powder and graphite powder. While the graphite powder as well as the aluminum powder is added to the mold oil 30 in this embodiment, the graphite powder may not be necessarily added, as is apparent from the results of examples which will be described later. The aluminum powder consists of flake aluminum particles 31, and the graphite powder consists of flake graphite particles 33.

It is desirable that the surface 21 that forms the cavity 20 of the casting mold 1 (11, 12) is uniformly coated with the mold oil 30. The coating method is not particularly limited, but may be selected from spraying, brushing, or immersing the casting mold 1 in an oil bath containing the mold oil.

It is preferable that the mold oil contains 10 to 34 mass % of aluminum powder. Namely, according to an experiment (which will be described later) conducted by the inventors, when the content of the aluminum powder is smaller than 10 mass %, or when the mold oil contains more than 64 mass % of refined mineral oil as the base oil, the amount of the aluminum powder added to the mold oil is not sufficient; therefore, it may be difficult to expect an effect of reducing pulling resistance due to the use of the aluminum powder as described above.

The flake aluminum particles 31 that constitute the aluminum powder may be obtained by stamping, more specifically, by crushing aluminum pieces along with a friction reducing agent, such as stearic acid, in a stamp mill, for example. In another method, the flake aluminum particles 31 may be obtained by ball milling, more specifically, by loading a drum with aluminum powder obtained by an atomization method, a lubricant, and a suitable liquid, along with rigid spheres, and crushing and grinding the aluminum powder.

Examples of the flake aluminum particles 31 include TCR 3030 (average particle size 21 μM, average thickness 1.2 μm, aspect ratio 18), TCR3040 (average particle size 16.7 μm, average thickness 0.8 μm, aspect ratio 21), MG1000 (average particle size 30 μm, average thickness 0.9 μm, aspect ratio 33), 7410NS (average particle size 29 μm, average thickness 0.8 μm, aspect ratio 36), 54-452 (average particle size 34 μm, average thickness 1.0 μm, aspect ratio 34), 1900M (average particle size 28 μm, average thickness 0.8 μm, aspect ratio 35), which are manufactured by Toyo Aluminum K. K., and so forth. It is more preferable that the average particle size is within the range of 5 to 30 μm. Each of the above examples may be used alone, or two or more kinds of aluminum particles may be combined and used.

The mold oil contains 24 mass % or less of graphite powder. The flake graphite particles 33 that constitute the graphite powder may be obtained by sintering a slurry-like mixture of natural graphite powder, and crushing the obtained sintered product by ball milling. The flake graphite particles 33 may also be obtained by crushing film-like graphite, which is formed from an aromatic polymer film as a starting material. It is preferable that the average particle size of the flake graphite particles 33 is within the range of 1 to 10 μm. Since these graphite particles are present between the aluminum particles, it is preferable to use graphite particles having the smaller particle size than the aluminum particles.

As the base oil that constitutes the mold oil 30, refined mineral oil having a heatproof temperature of 250° C. or higher is used. The mold oil 30 contains 40 to 64 mass % of the refined mineral oil, relative to the entire mass of the mold oil (including the above-described powders).

If the content of the aluminum powder exceeds 34 mass %, and the content of the graphite powder exceeds 24 mass %, while the content of the refined mineral oil is smaller than 40 mass %, the proportion of the oil content in the mold oil is reduced, and oil films may not be sufficiently formed on surfaces of the particles of these powders.

It is found from an experiment conducted by the inventors that, when the heatproof temperature of the refined mineral oil is lower than 250° C., the refined mineral oil vaporizes or evaporates during casting of aluminum alloy, and it is difficult to ensure a sufficient oil content of the base oil in the mold oil 30. The "heatproof temperature of the refined mineral oil" mentioned in this embodiment of the invention means the boiling point of the refined mineral oil at which the oil vaporizes, and the refined mineral oil having the heatproof temperature of 250° C. or higher means refined mineral oil whose boiling point is 250° C. or higher.

As is understood from the above description, when the mold oil contains 40 to 64 mass % of refined mineral oil having the heatproof temperature (boiling point) within the above-described range, the mold oil keeps a sufficient oil content of base oil (refined mineral oil) during casting, and oil films are surely formed on particle surfaces of the aluminum powder and graphite powder.

Examples of refine mineral oil having a heatproof temperature (boiling point) of 250° C. or higher include refined mineral oils, such as heavy oil, and light oil.

The carbon film 22 may be further coated with fullerene. "Fullerene" is a carbon cluster having a closed-shell structure, and the number of carbons is normally an even number within the range of 60 to 130. Specific examples of fullerene include C60, C70, C76, C78, C80, C82, C84, C86, C88, C90, C92, C94, C96, and high-order carbon clusters each having a larger number of carbons. Fullerene includes, in addition to the above-indicated fullerenes, fullerene derivatives in which fullerene molecules are chemically modified with other molecules or functional groups. The carbon film 22 may be coated with the fullerenes, using a mixture of the above-indicated fullerenes and other substances.

With the aluminum powder thus added to the mold oil 30, the flake aluminum particles 31, on which oil films of the oil component of the mold oil 30 are formed, are present between the surface that forms the cavity 20 of the casting mold 1, and the surface of the cast article, during casting, such that the aluminum particles 31 are opposed to these surfaces.

If the graphite powder is further added, the flake graphite particles 33 are present between the aluminum particles 31. In the presence of the graphite powder, adhesion between the aluminum particles 31 is curbed or inhibited, and pulling resistance between the cavity-forming surface of the casting mold and the surface of the cast article can be reduced.

Also, the surface 21 that forms the cavity is covered with the carbon film 22 including nanocarbon, and the carbon film 22 is coated with the mold oil 30, so that the carbon film 22 is impregnated with the refined mineral oil, and oil can be retained iri the carbon film 22. In this manner, oil films consisting of the refined mineral oil can be stably formed on the surfaces of the aluminum particles and graphite particles. As a result, the friction between the split casting molds 11, 12 and the cast article can be reduced.

Thus, when the cast article is released from the casting mold 1, the pulling resistance of the casting mold 1 against the cast article is reduced, and the cast article can be more easily released from the casting mold 1. In addition, even if the casting mold has a reduced draft or amount of taper (for example, the draft is equal to zero), a part of the cast article is hardly attached to the casting mold, and the cast article can be successfully released from the casting mold. Consequently, the degree, of freedom for the shape of the cast article can be increased.

During casting, the aluminum particles 31 are present between the surface that forms the cavity 20 of the casting mold 1, and the molten metal. Therefore, the molten metal is inhibited from striking the surface of the casting mold. Thus, the lifetime of the casting mold can be prolonged.

In the following, some examples of the invention and comparative examples will be explained.

EXAMPLE 1

A test piece 51 having dimensions of 200 mm×200 mm×30 mm and made of iron (according to JISG4404: SKD61), which corresponds to a substrate of a casting mold, was prepared. The test piece 51 was put into an atmosphere furnace. After the pressure was reduced by a vacuum pump, and the air was purged, nitrogen gas ($N_2$) was caused to flow through the furnace, so that an $N_2$ atmosphere was present in the furnace. Then, the temperature was elevated to 480° C. within 0.5 h, while reaction gases (hydrogen sulfide ($H_2S$) gas, acetylene ($C_2H_2$) gas, ammonia ($NH_3$) gas) were caused to flow through the furnace. When the temperature reached 480° C. after 0.5 h elapsed from the start of heating, the supply of the hydrogen sulfide gas was stopped. After a further lapse of 0.5 h, the supply of the acetylene gas was stopped. The temperature was kept at 480° C. for additional 4.5 h while the ammonia gas was caused to flow through the furnace. Thereafter, the supply of the ammonia gas was stopped, the atmosphere in the furnace was replaced by nitrogen gas, and the temperature started being lowered. As a result, the surface of the test piece was covered with a carbon film comprised of nanocarbon, and a nitride layer and a sulfurized layer were formed between the test piece and the nanocarbon carbon film.

Figure 2A:
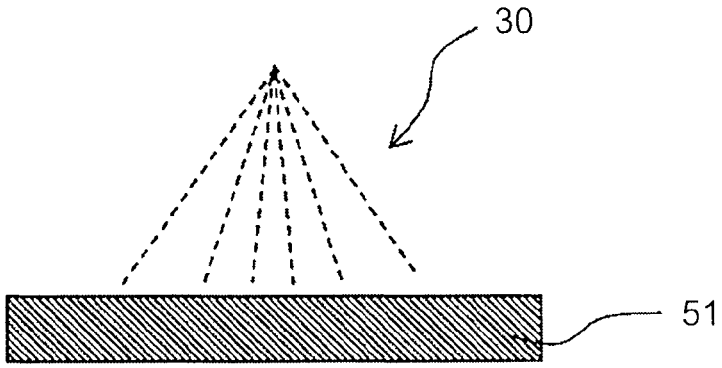
FIG. 2A is a view explaining a mold release resistance measurement test device used in Example 1 and Comparative Example 1, which view shows a step of coating with mold oil.

Then, a mold oil (mold release agent) was prepared by uniformly mixing 44 mass % of refined mineral oil A (commercially available heavy oil) having a heatproof temperature of 250° C. or higher, 20 mass % of refined mineral oil B (paraffinic base oil) having a heatproof temperature of 250° C. or lower, 24 mass % of aluminum powder (aluminum paste M-801 manufactured by Asahi Kasei Corp.) consisting of flake aluminum particles, and graphite powder (flake graphite CNP manufactured by Ito Kokuen Co., Ltd.)

consisting of flake graphite particles. The mold oil was applied by coating to the surface of the carbon film on the test piece, as shown in FIG. 2A.

COMPARATIVE EXAMPLE 1

A test piece was prepared in the same manner as in Example 1. Comparative Example 1 is different from Example 1 in that the carbon film formed on the surface of the test piece was coated with mold oil to which aluminum powder and graphite powder were not added.

<Mold Release Resistance Measurement Test>

Figure 2B:
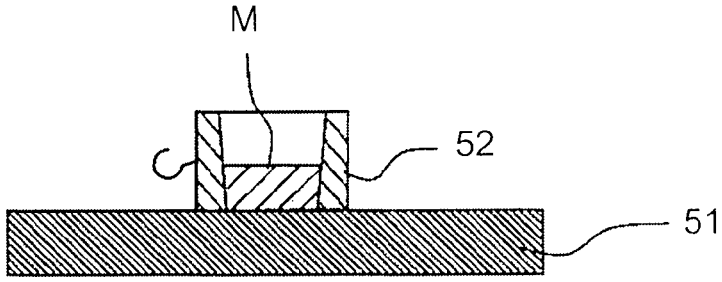
FIG. 2B is a view explaining the mold release resistance measurement test device used in Example 1 and Comparative Example 1, which view shows a step of pouring molten metal.
Figure 2C:
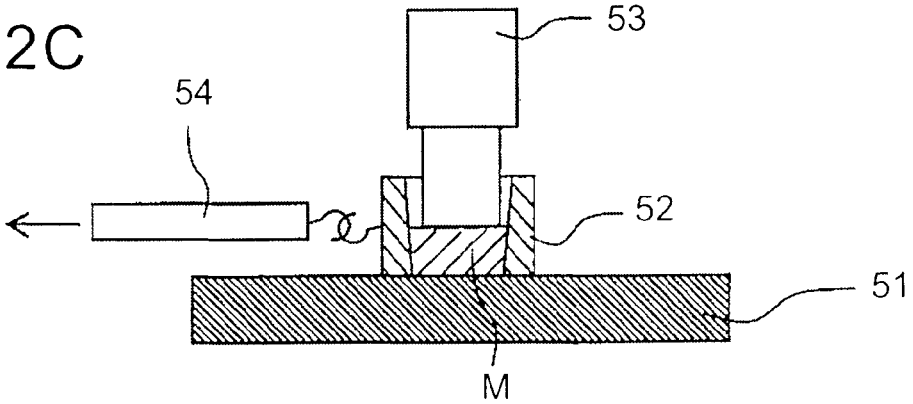
FIG. 2C is a view explaining the mold release resistance measurement test device used in Example 1 and Comparative Example 1, which view shows a step of measuring a mold release load by pulling.

The mold release resistance was measured on each of the treated surfaces of the test pieces according to the above-described Example 1 and Comparative Example 1, on which the carbon films were formed, using an automatic tension testing device Lub-Teste-U (available from MEC International Co., Ltd.). As shown in FIG. 2B, the Lub-Tester-U is a device for measuring frictional resistance in the following manner. Initially, a ring body 52 was placed on the test piece 51, and molten aluminum M was poured into the ring body 52, as shown in FIG. 2B. After aluminum was solidified, a weight 53 was placed on the solid aluminum, and frictional resistance was measured by pulling the ring body 52, as shown in FIG. 2C.

More specifically, the ring body 52 made of SKD 61 was prepared. A surface of the ring body 52 which contacts with the test piece 51 has an inside diameter of 70 mm and an outside diameter of 90 mm, and the height of the ring body 52 is 50 mm. The inside diameter of the ring body 52 slightly increases as the distance measured in the height direction from its surface contacting with the test piece 51 increases.

Figure 3:
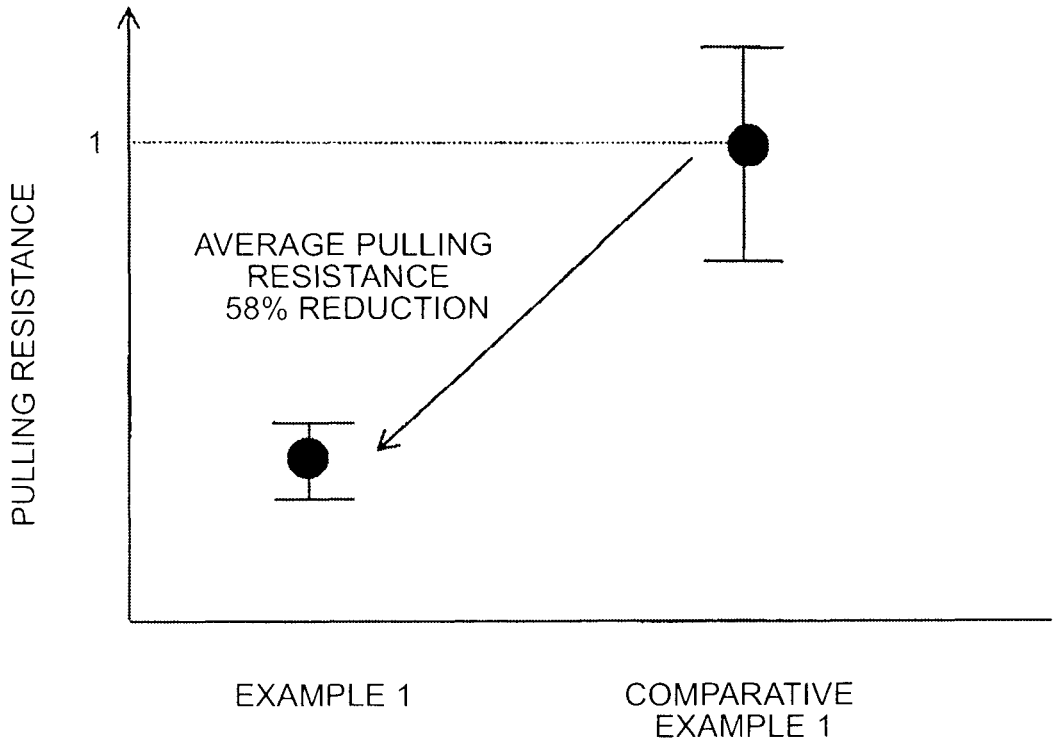
FIG. 3 is a view showing test results of mold release resistance measurements on test pieces of Example 1 and Comparative Example 1.

Aluminum alloy die casting (ADC 12: JISH 5302) was used as the molten aluminum M. More specifically, the ring body 52 was placed on the test piece 51 as shown in FIG. 2B, and 90 cc of the molten aluminum (ADC 12) having a temperature of 650° C. was poured into the ring body 52, cooled for 40 sec., and solidified. Then, a 9-kg weight 53 made of iron was placed on the solid aluminum M, as shown in FIG. 2C, and the mold releasing load (pulling resistance) was measured while the ring body 52 was being pulled in the direction of the arrow (in FIG. 2C) at a constant speed of 50 mm/s, using a push-pull 54. Two cycles of the mold release resistance measuring test were conducted on each of the test pieces of Example 1 and Comparative Example 1. The results and average values of the pulling resistance are shown in FIG. 3. In FIG. 3, the pulling resistance is normalized so that the average value of the pulling resistance of Comparative Example 1 becomes equal to 1.

<Result 1>

As shown in FIG. 3, the pulling resistance of the test piece according to Example 1 was reduced by 58% as compared with that of Comparative Example 1. This may be because, in the case of Example 1, the friction between the surface of the test piece and the surface of the cast article was reduced due to the aluminum powder and graphite powder added to the mold oil.

Further, the surface of the test piece according to Example 1 was covered with the carbon film containing nanocarbons, and the carbon film was impregnated with the base oil of the mold oil. As a result, it may be considered that the refined mineral oil as the base oil was supplied to the surfaces of the particles of the added aluminum powder and graphite powder, as well as the surface of the test piece, and oil films were stably formed on the surfaces of the particles. Consequently, it may be considered that a low-friction condition could appear continuously and stably, and the pulling resistance of the test piece according to Example 1 was reduced as compared with that of Comparative Example 1.

EXAMPLE 2

Figure 4:
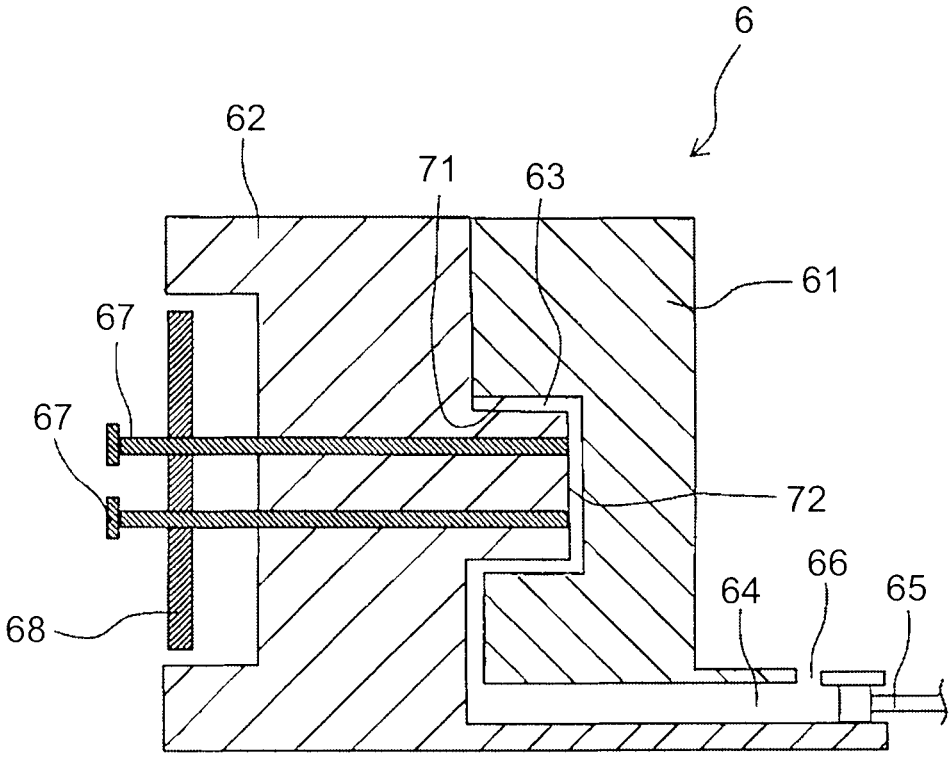
FIG. 4 is a schematic cross-sectional view of a die of a die casting device used in Example 2.

A die-casting die of an aluminum casting device 6 as shown in FIG. 4 was produced. The die-casting die is a casting mold for a housing of an automotive transaxle made of SKD 61. The die-casting die consists of a fixed mold 61 and a movable mold 62. When the fixed mold 61 and the movable mold 62 are clamped together, a cavity 63 is formed between the fixed mold 61 and the movable mold 62. The cavity 63 is surrounded by a cavity surface of the fixed mold 61 and a cavity surface of the movable mold 62, and the draft formed by the fixed mold 61 and the movable mold 62 is equal to zero. The cavity surfaces 71, 72 were covered with carbon films in the same manner as that of Example 1, and each of samples of mold oil having compositions 1 to 8 as indicated in TABLE 1 below was applied by coating to the carbon films, for each casting test as will be described below. The mold oil having composition 2 corresponds to the mold oil used in Example 1.

TABLE 1

| | Content in Mold Oil (mass %) | | | | | | | |
|---|---|---|---|---|---|---|---|---|
| | Com. 1 | Com. 2 | Com. 3 | Com. 4 | Com. 5 | Com. 6 | Com. 7 | Com. 8 |
| Aluminum Powder | 24.0 | 24.0 | 24.0 | 0.0 | 34.0 | 10.0 | 10.0 | 50.0 |
| Graphite powder | 10.0 | 10.0 | 10.0 | 34.0 | 0.0 | 24.0 | 10.0 | 25.0 |
| Refined mineral oil A | 0.0 | 44.0 | 64.0 | 44.0 | 44.0 | 44.0 | 54.0 | 16.2 |
| Refined mineral oil B | 64.0 | 20.0 | 0.0 | 20.0 | 20.0 | 20.0 | 24.0 | 6.8 |
| Trace of drug | 2.0 | 2.0 | 2.0 | 2.0 | 2.0 | 2.0 | 2.0 | 2.0 |

Com.: Composition

COMPARATIVE EXAMPLE 2

In the same manner as in Example 2, a fixed mold 61 and a movable mold 62 were produced. Comparative Example 2 is different from Example 2 in that the cavity surfaces 71, 72 of the fixed mold 61 and movable mold 62 were subjected to a nitriding treatment, instead of being covered with carbon films, so that the cavity surfaces 71, 72 were covered with nitride films. In Comparative Example 2, too, each of the samples of mold oil having compositions 1 to 8 as indicated in TABLE 1 above was applied by coating to the cavity surfaces 71, 72 covered with the nitride films, for each casting test, as in Example 2.

COMPARATIVE EXAMPLE 3

In the same manner as in Example 2, a fixed mold 61 and a movable mold 62 were produced. Comparative Example 3 is different from Example 2 in that the cavity surfaces 71, 72 of the fixed mold 61 and movable mold 62 were not covered with carbon films. In Comparative Example 3, too, each of the samples of mold, oil having compositions 1 to 8 as indicated in TABLE 1 above was applied by coating to the cavity surfaces 71, 72, for each casting test, as in Example 2.

<Casting Test>

A casting test was conducted, using the aluminum casting device 6 as shown in FIG. 4, in which the fixed mold 61 and movable mold 62 according to each of Example 2 and Comparative Examples 2, 3 were used. ADC 12 was used as an aluminum alloy to be cast, and the fixed mold 61 and the movable mold 62 were clamped together at a clamping pressure of 2000 t. Thereafter, molten aluminum (ADC12) was poured into a molten-metal pour channel 64 through a molten-metal inlet 66. Then, the molten aluminum having a temperature of 670° C. was fed to the cavity 63, by means of a plunger 65, at a casting pressure of 46 MPa and an injection speed of 3 m/s, so as to be molded by casting. After the fixed mold 61 and the movable mold 62 were spaced apart from each other, core pins 67 (made of SKD 61) were operated or moved in such a direction as to protrude from the cavity surface 72, so as to take out an aluminum cast article. For Example 2, and Comparative Examples 2, 3, the process from coating with the mold oil having each composition 1 to 8 to take-out of the cast article, which process is one shot of casting test, was repeated.

In the casting test, a condition of adhesion of aluminum alloy (a part of the cast article) to the surfaces of the fixed mold 61 and movable mold 62 according to each of Example 2 and Comparative Examples 2, 3 using the mold oil of each composition was checked. The results of the test are indicated in TABLE 2 below.

TABLE 2

| | Com. 1 | Com. 2 | Com. 3 | Com. 4 | Com. 5 | Com. 6 | Com. 7 | Com. 8 |
|---|---|---|---|---|---|---|---|---|
| Example 2 | C | A | B | C | B | B | B | C |
| Comparative Example 2 | D | C | D | D | D | D | D | D |
| Comparative Example 3 | D | D | D | D | D | D | D | D |

A: No aluminum alloy adheres to the mold surfaces.
B: A small amount of aluminum alloy adheres to the mold surfaces, but can be easily removed.
C: A somewhat large amount of aluminum alloy adheres to the mold surfaces, but can be removed.
D: A considerably large amount of aluminum alloy adheres to the mold surfaces, and is difficult to remove.

<Result 2>

As indicated in TABLE 2 above, the amount of aluminum alloy adhering to the fixed mold and movable mold according to Comparative Examples 2 and 3 was considerably large, and it was difficult to remove the aluminum alloy. In the case of Example 2, none of the fixed mold and the movable mold suffered from aluminum alloy adhering to the mold surfaces.

It may be concluded from the results of Example 2 using the mold oils having compositions 2, 3, 5 to 7 that, if the mold oil contains 10 to 34 mass % of aluminum powder, 24 mass % or less of graphite powder, and 40 to 64 mass % of refined mineral oil A having a heatproof temperature of 250° C. or higher, almost no aluminum alloy adheres to the mold surfaces, and the pulling resistance is reduced.

Where only the refined mineral oil B having a heatproof temperature of 250° C. or lower is, used, as is the case with composition 1, or where the content of the refined mineral oil A having a heatproof temperature of 250° C. or higher in the mold oil is small, as is the case with composition 8, it is difficult to retain the refined mineral oil between the surfaces of the fixed mold and movable mold and the cast article, during casting. Therefore, it may be considered that the aluminum alloy adhered to the fixed mold and the movable mold, since it is difficult to retain oil films on the surfaces of particles that constitute the aluminum powder and graphite powder.

Where no aluminum powder is added, but only graphite powder is added, as is the case with composition 4, the intended effect of reducing the pulling resistance due to the use of aluminum powder cannot be expected. It may be considered that the aluminum alloy adhered to the fixed mold and the movable mold, for this reason.

While the invention has been described in detail, using the embodiment of the invention, the invention is not limited to the illustrated embodiment and examples as described above, but may be embodied with various design changes or modifications, without departing from the principle of the invention.

In the illustrated embodiment, flake aluminum particles and flake graphite particles are preferably used. However, the shape of the particles may be spherical or elliptical, for example, provided that the particles can yield the effect of reducing the pulling resistance as described above.

The invention claimed is:

1. A casting mold comprising:

a carbon film with which at least a surface of the casting mold which forms a cavity is covered; and a mold oil with which a surface of the carbon film is coated, wherein an aluminum powder is added to the mold oil.

2. The casting mold according to claim 1, wherein the aluminum powder comprises flake aluminum particles.

3. The casting mold according to claim 1, wherein a graphite powder is further added to the mold oil.

4. The casting mold according to claim 3, wherein the graphite powder comprises flake graphite particles.

5. The casting mold according to claim 3, wherein the mold oil contains 10 to 34 mass % of the aluminum powder, 24 mass % or less of the graphite powder, and 40 to 64 mass % of refined mineral oil having a heatproof temperature of 250° C. or higher.

6. The casting mold according to claims 1, wherein the carbon film contains at least one type of nanocarbons selected from the group consisting of carbon nanocoils, carbon nanotubes, and carbon nanofilaments.

7. A cast article produced by using the casting mold according to claim 1.

* * * * *